US010258533B1

(12) United States Patent
Chu et al.

(10) Patent No.: US 10,258,533 B1
(45) Date of Patent: Apr. 16, 2019

(54) FOLDABLE CRUTCH

(71) Applicants: Zooey Chi-Tien Chu, Byron Center, MI (US); Douglas Pan, Tainan (TW)

(72) Inventors: Zooey Chi-Tien Chu, Byron Center, MI (US); Douglas Pan, Tainan (TW)

( * ) Notice: Subject to any disclaimer, the term of this patent is extended or adjusted under 35 U.S.C. 154(b) by 0 days.

(21) Appl. No.: 15/953,565

(22) Filed: Apr. 16, 2018

(51) Int. Cl.
*A61H 3/02* (2006.01)
*A45B 9/00* (2006.01)

(52) U.S. Cl.
CPC ..... *A61H 3/02* (2013.01); *A45B 2009/005* (2013.01); *A61H 2201/0161* (2013.01); *A61H 2201/1614* (2013.01); *A61H 2201/1635* (2013.01)

(58) Field of Classification Search
CPC ..... A61H 3/02; A61H 2201/0161; A45B 2009/005
USPC ..... 135/74
See application file for complete search history.

(56) References Cited

U.S. PATENT DOCUMENTS 2,408,604 A * 10/1946 Brickson ..... A61H 3/02 135/69
2,559,421 A * 7/1951 Garrett ..... A45B 11/00 108/50.12
4,877,045 A * 10/1989 Lin ..... A45B 17/00 135/20.3
6,032,917 A * 3/2000 Shannon ..... A45B 17/00 135/16
2004/0139995 A1* 7/2004 Hsieh ..... A61H 3/02 135/69
2010/0206348 A1 8/2010 Markou
2015/0297438 A1* 10/2015 Hsu ..... A61H 3/02 135/69

FOREIGN PATENT DOCUMENTS

TW M266902 U 6/2005
TW M442839 U 12/2012

* cited by examiner

*Primary Examiner* — Noah Chandler Hawk
(74) *Attorney, Agent, or Firm* — Alan D. Kamrath; Kamrath IP Lawfirm, P.A.

(57) ABSTRACT

A foldable crutch includes an upper rod having a pad portion on a top end thereof and a first coupling portion at a bottom end thereof. The first coupling portion includes at least one positioning groove and a receiving groove. A handle is disposed on the upper rod. A lower rod includes an upper end having a second coupling portion mounted to the first coupling portion. The second coupling portion includes a positioning member for coupling with the positioning groove or the receiving groove. A turn knob is mounted to the first coupling portion. An axle extends through the first and second coupling portions and is pivotably connected to the turn knob. An elastic element biases the first and second coupling portions to disengage the positioning member from the at least one positioning groove when the turn knob is in the unlocking position.

10 Claims, 13 Drawing Sheets

A – A

FOLDABLE CRUTCH

BACKGROUND OF THE INVENTION

The present invention relates to a foldable crutch and, more particularly, to a crutch that can be extended or folded and that provides easy adjustment, assembling stability, and wider applications.

Walking, aids include walking sticks, forearm crutches, underarm crutches, etc. FIG. 13 shows a conventional underarm crutch including a leg portion 1', a connecting frame 2', a pad 3', and a handgrip 4'. A soft tip 11' is attached to a lower end of the leg portion 1'. The connecting frame 2' includes two side bars 21'. The pad 3' is fixed to upper ends of the side bars 21'. The upper section of the leg portion 1' is fixed to lower ends of the two side bars 21'. The handgrip 4' is interconnected between intermediate portions of the two side bars 21'. Thus, a user can place his or her armpit on the pad 3' while gripping the handgrip 4'. The tip 11' forms a support when contacting with the ground.

However, the above underarm crutch has several disadvantages. Firstly, the underarm crutch has a considerable length larger than the spacing between the armpit of the user to the ground, which is inconvenient to storage and transportation in a car. Secondly, the soft tip 11' provides an unsatisfactory shock absorbing effect, failing to provide comfort use. Thirdly, the pad 3' and the handgrip 4' are difficult to adjust in height and, thus, cannot be used by different users. Lastly, the user must securely hold the pad 3' by the armpit or securely grip the handgrip 4' to avoid the underarm crutch from falling off the arm of the user. However, falling off of the underarm crutch still occurs. To solve the above disadvantages, Taiwan Utility Model No. M266902 disclose a crutch including an upper rod unit, a lower rod unit, and a locking portion for rapidly assembling and separating the upper and lower rod units. An armpit pad is mounted to a top end of the upper rod unit. The upper rod unit includes a handgrip at an appropriate location. An end of the lower rod unit is coupled by the locking portion to an end of the upper rod unit opposite to the armpit pad. The locking portion includes a at least one jacket, at least one insertion tube that can be inserted into the at least one jacket, and at least one buckle annularly disposed on an outer edge of the at least one jacket. The at least one jacket is mounted around the end of the upper rod unit opposite to the armpit pad. The at least one insertion rod is mounted around an end of the lower rod unit that is coupled to the upper rod unit. The at least one insertion rod can be inserted into the at least one jacket to couple the upper rod unit and the lower rod unit together. Furthermore, the buckle can be rotated to a tightening position securing the upper and lower rod unit together and a loosening position permitting the upper and lower rod units to disengage from each other. However, the assembly and folding requires rotation of the buckle. Furthermore, the upper and lower rod units can still wobble or even disengage from each other when the buckle is not tightened. Furthermore, the upper and lower rod units, when disengaged from each other, are not securely connected, failing to provide folding integrity.

Taiwan Utility Model No. M442839 discloses a crutch having a spring mounted to the bottom end of the center post to provide a buffering elasticity. However, the spring and corresponding components increase the costs in the components and assemblage. U.S. Patent Publication No. 2010/0206348 discloses a crutch including a flexible limb to provide improved comfort use. However, the flexible limb could bend excessively when subject to a larger force, leading to a great change in the length of the crutch and adversely affecting the use safety. If the flexible limb is made of a more rigid material to reduce the deformation, the buffering effect and the use comfort are sacrificed.

BRIEF SUMMARY OF THE INVENTION

An objective of the present invention is to provide a foldable crutch that can be extended or folded and that provides easy adjustment, assembling stability, and wider applications.

Another objective of the present invention is to provide a foldable crutch providing an improved buffering effect and improved use comfort.

A further objective of the present invention is to provide a foldable crutch that is less likely to fall off from the user while permitting adjustment of a length of the foldable crutch to provide wider applications.

A foldable crutch according to the present invention includes an upper rod having a pad portion on a top end thereof. The upper rod further includes a first coupling portion on a bottom end thereof. The first coupling portion includes a first outer surface and a first inner surface. The first coupling portion further includes a central portion having a first axle hole extending from the first outer surface through the first inner surface. The first coupling portion further includes a peripheral portion surrounding the first axle hole. At least one positioning groove and a receiving groove are defined in the peripheral portion and are spaced from each other in an angular direction. A handle is mounted on the upper rod. A lower rod includes an upper end having a second coupling portion mounted to the first coupling portion. The second coupling portion includes a second outer surface, a second inner surface, and a second axle hole extending from the second outer surface through the second inner surface. A positioning member is disposed on the second inner surface and is engaged in the at least one positioning groove or the receiving groove.

The foldable crutch further includes a locking device including a turn knob, an axle, an elastic element, and an assembling piece. The turn knob includes a gripping portion and a pivotal portion connected to the gripping portion. The pivotal portion of the turn knob is mounted to the first coupling portion of the upper rod. The pivotal portion of the turn knob includes a first side corresponding to a locking position and a second side corresponding to an unlocking position. The first side extends at a non-parallel angle to the second side. The axle includes a first side having a pivotal portion pivotably connected to the pivotal portion of the turn knob. The axle further includes a second side having a shank portion extending through the first axle hole and the second axle hole. The elastic element biases the first coupling portion and the second coupling portion to disengage the positioning member from the at least one positioning groove when the turn knob is in the unlocking position. The assembling piece has a width larger than a diameter of the second axle hole. The assembling piece is disposed on the second coupling portion and is coupled to an end of the shank portion of the axle.

When the turn knob is in the locking position, the first side of the turn knob faces the first axle hole, the second coupling portion is pulled by the axle toward the first coupling portion, such that the positioning member engages with the at least one positioning groove. When the turn knob is turned to the unlocking position, the second side of the pivotal portion of the turn knob faces the first axle hole, the positioning member disengages from the at least one positioning groove, and the upper rod is pivotable relative to the lower rod to a folding state. When the turn knob is moved back to the unlocking position while the first rod and the second rod are in the folding state, the positioning member is engaged in the receiving groove.

In an example, the first inner surface of the first coupling portion includes a flange around the first axle hole. The second inner surface of the second coupling portion includes an annular groove around the second axle hole and located corresponding to the flange of the first coupling portion. The elastic element is a compression spring mounted in the annular groove of the second coupling portion and includes two ends respectively abutting the first coupling portion and the second coupling portion.

In an example, the first outer surface of the first coupling portion includes a central portion having a first recessed portion around the first axle hole. An abutment plate is mounted in the first recessed portion. The pivotal portion of the turn knob is received in the first recessed portion. The second outer surface of the second coupling portion includes a second recessed portion around the second axle hole. The shank portion of the axle includes a connecting end extending in the second recessed portion and having a threaded portion. The assembling piece is received in the second recessed portion and has a screw hole in threading connection with the threaded portion of the connecting end of the axle.

In an example, the second recessed portion of the second coupling portion includes an engagement hole. The locking device further includes a cap. The cap includes a head and a tab extending from the head. The tab of the cap engages with the engagement hole of the second coupling portion. The head of the cap covers the second recessed portion.

In an example, the at least one positioning groove of the first coupling portion includes a plurality of positioning grooves located in a range of 180° around the first axle hole. The receiving groove extends another 180° around the first axle hole. A limiting groove is disposed in the receiving groove. A limiting member protrudes from the second inner surface of the second coupling portion, is longer than the positioning member, and is movable in the limiting groove.

In an example, the foldable crutch further includes a supporting rod. The lower rod includes a central portion having a coupling groove. The lower rod includes a lateral wall having a coupling hole in communication with the coupling groove. The supporting rod is mounted to a lower end of the lower rod and includes an upper end having a coupling section and a lower end having a supporting section. The coupling section includes a plurality of coupling holes at different heights. A coupling knob extends through one of the plurality of coupling holes of the coupling section into the coupling hole of the lower rod.

In an example, the foldable crutch further includes a supporting rod mounted to a lower end of the lower rod. The supporting rod includes an upper end having a coupling section and a lower end having a supporting section. The coupling section is coupled to the lower rod. The supporting section includes a rectilinear section connected to a lower end of the coupling section. The rectilinear section includes an arcuate portion at a lower end thereof. The arcuate portion includes a central, upper portion connected to the rectilinear portion and a bend portion that is elastic. The arcuate portion further includes a bottom adapted to contact with a ground and located below the bend portion. The bend portion includes an upper inner face and a lower inner face. An upper abutting plate protrudes from the upper inner face. A lower abutting plate protrudes from the lower inner face and is spaced from the upper abutting plate by a spacing.

In an example, the upper rod includes a central portion having a plurality of coupling holes located at different heights. The handle includes a handgrip and a connecting knob. The handgrip is disposed on the upper rod and includes an engaging portion on a side thereof. The engaging portion includes a coupling hole. The engaging portion is mounted to one of the different heights. The connecting knob extends through one of the plurality of coupling holes of the upper rod into the coupling hole of the handle.

In an example, the foldable crutch further includes a shoulder strap disposed on the pad portion.

In an example, the upper rod includes a coupling peg on a top end thereof. The pad portion includes a pad having a coupling hole located corresponding to the coupling peg. The shoulder strap includes an engaging hole for coupling with the coupling peg. The shoulder strap includes two connecting ends at two ends thereof. The two connecting ends are detachably coupled with each other. A fastener extends through the coupling hole of the pad into the coupling peg.

The present invention will become clearer in light of the following detailed description of illustrative embodiments of this invention described in connection with the drawings.

DESCRIPTION OF THE DRAWINGS

FIG. 1A is an enlarged view of a circled portion of the foldable crutch of FIG. 1.

FIG. 1B is an enlarged view of another circled portion of the foldable crutch of FIG. 1.

FIG. 2A is an enlarged view of a circled portion of the foldable crutch of FIG. 2.

FIG. 2B is an enlarged view of another circled portion of the foldable crutch of FIG. 2.

DETAILED DESCRIPTION OF THE INVENTION

Figure 1:
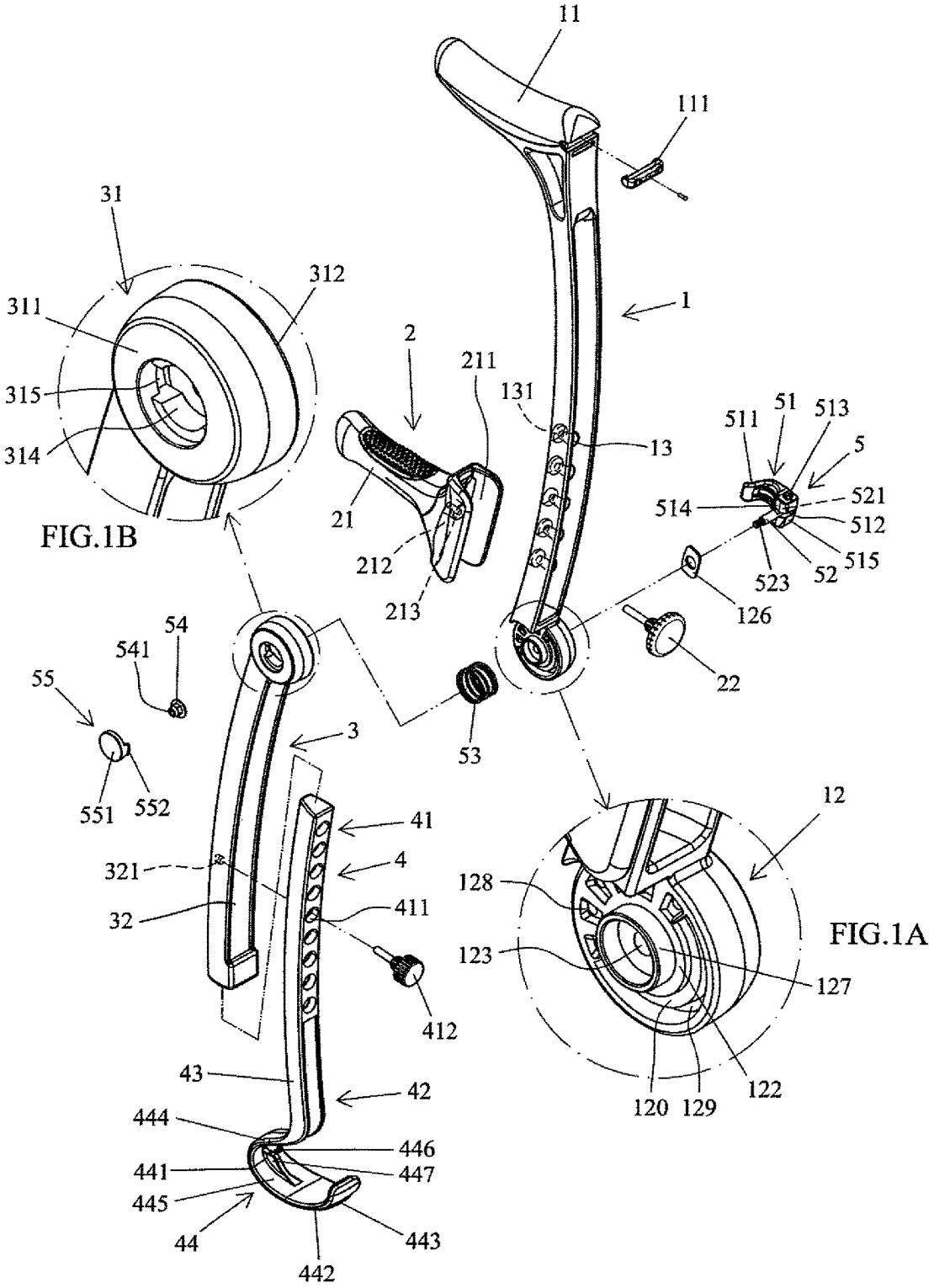
FIG. 1 is an exploded, perspective view of a foldable crutch of an embodiment according to the present invention.
Figure 2:
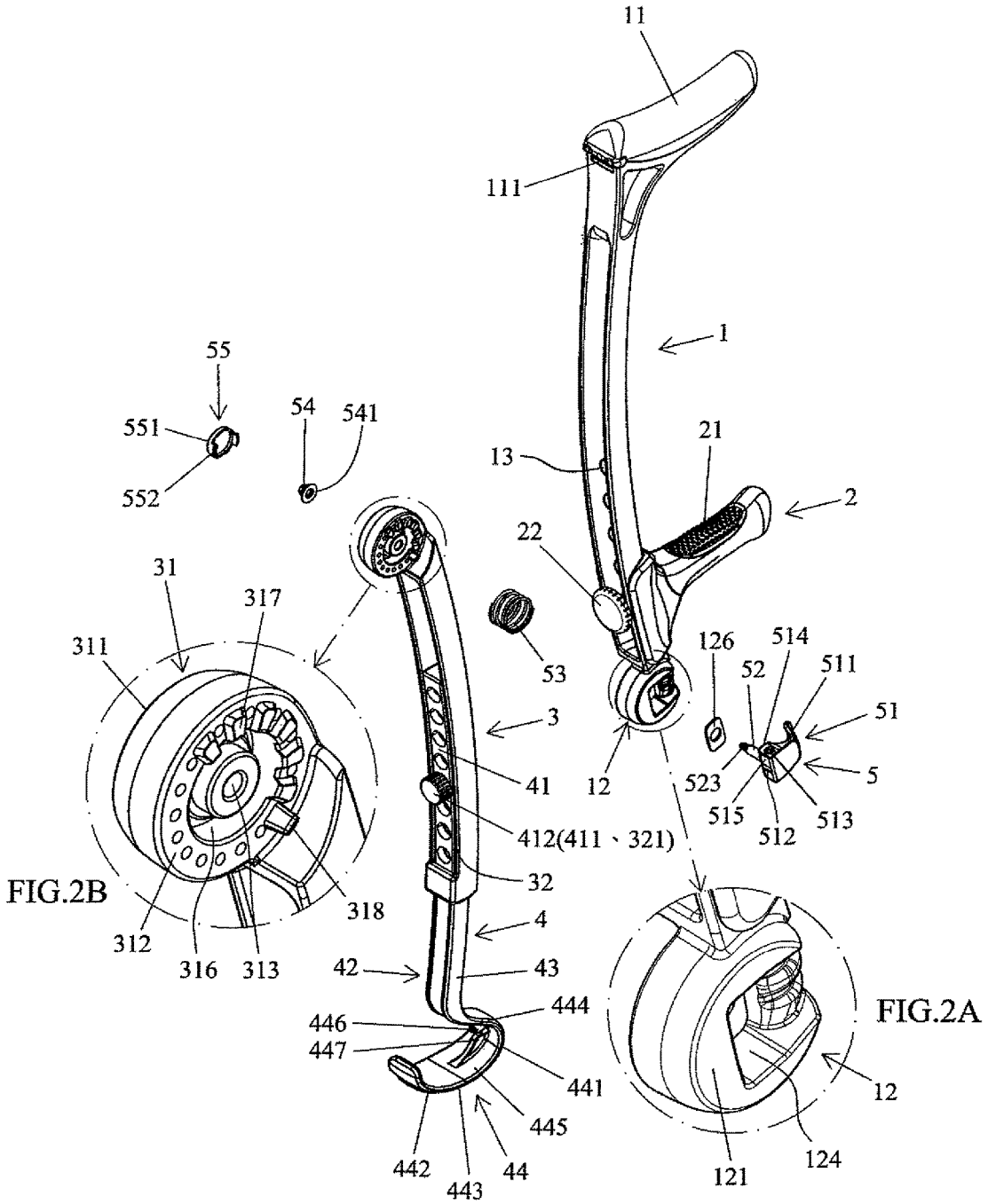
FIG. 2 is another exploded, perspective view of the foldable crutch according to the present invention.
Figure 3:
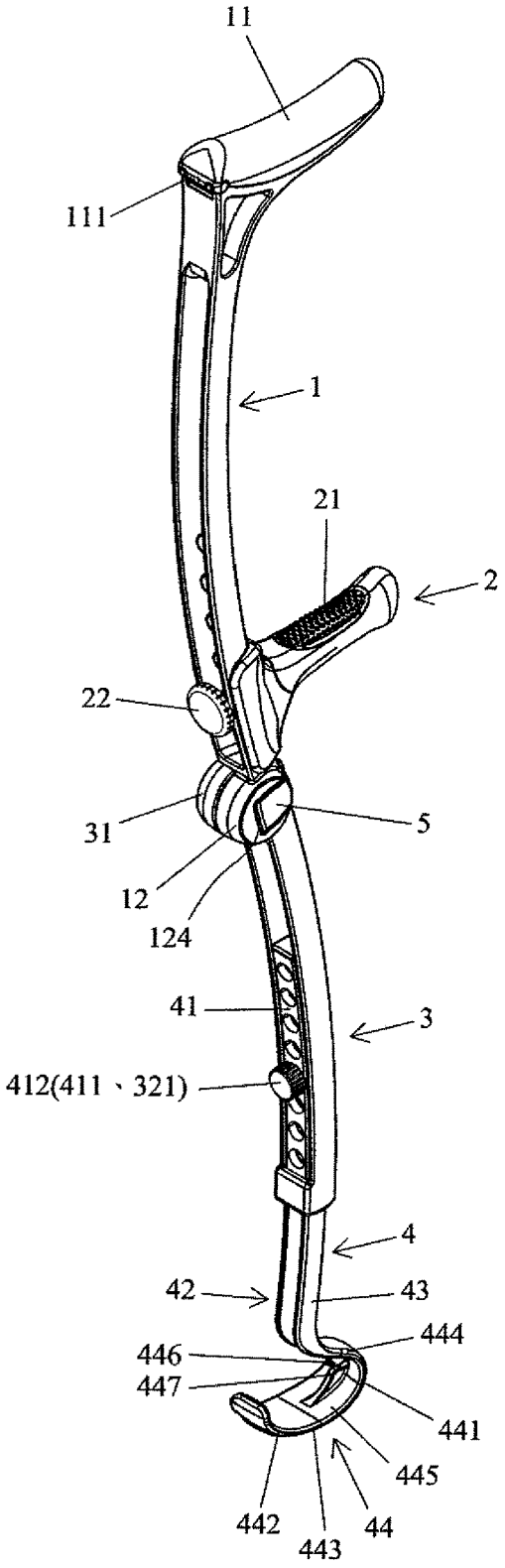
FIG. 3 is a perspective view of the foldable crutch of FIG. 1, with the foldable crutch being in an extended state.

With reference to FIGS. 1-5, a foldable crutch of an embodiment according to the present invention includes an upper rod 1, a handle 2, a lower rod 3, a supporting rod 4, and a locking device 5. The upper rod 1 includes a pad portion 11 on a top end thereof. The upper rod 1 further includes a first coupling portion 12 on a bottom end thereof. The upper rod 1 further includes a central portion having a plurality of coupling holes 13 located at different heights. Each of the plurality of coupling holes 13 includes an end having a countersink 131 with a larger diameter. An anti-slip member 111 is disposed on a rear side of the pad portion 11. When the foldable crutch props against a wall (not shown), the anti-slip member 111 avoids slipping of the foldable crutch and, thus, provides a positioning effect. The first coupling portion 12 is circular in cross section. The first coupling portion 12 includes a first outer surface 121 and a first inner surface 122. The first coupling portion 12 further includes a central portion having a first axle hole 123 extending from the first outer surface 121 through the first inner surface 122. The first outer surface 121 of the first coupling portion 12 includes a central portion having a first recessed portion 124 around the first axle hole 123. An abutment plate 126 with improved strength is mounted in the first recessed portion 124. The first inner surface 122 of the first coupling portion 12 includes a flange 127 around the first axle hole 123. The first coupling portion 12 further includes a peripheral portion surrounding the first axle hole 123. The peripheral portion of the first coupling portion 12 includes a plurality of positioning grooves 128 around the first axle hole 123. In this embodiment, first coupling portion 12 includes six positioning grooves 128 located in a range of 180° around the flange 127 which is located around the first axle hole 123. Furthermore, the first coupling portion 12 includes a receiving groove 120 extending another 180° around the first axle hole 123. A limiting groove 129 is defined in a bottom face of the receiving groove 120.

The handle 2 includes a handgrip 21 and a connecting knob 22. The handgrip 21 is disposed on the upper rod 1 and includes an engaging portion 211 on a side thereof. The engaging portion 211 includes a coupling hole 212. The engaging portion 211 is mounted to a desired height at the upper rod 1. The engaging portion 211 further includes a protrusion 213 located outward of the coupling hole 212. The engaging portion 211 of the handle 2 is coupled to a desired height of the upper rod 1, and the protrusion 213 engages with the countersink 131 of one of the plurality of coupling holes 13 of the upper rod 1. Thus, the coupling hole 212 of the handgrip 21 is aligned with the one of the plurality of coupling holes 13 of the upper rod 1. Then, the connecting knob 22 extends through the one of the plurality of coupling holes 13 of the upper rod 1 into the coupling hole 212 of the handgrip 21 to fix the handle 2 to a desired position.

The lower rod 3 includes an upper end having a second coupling portion 31 mounted to the first coupling portion 12. The lower rod 3 includes a central portion having a coupling groove 32. The lower rod 3 further includes a lateral wall having a coupling hole 321 in communication with the coupling groove 32. The second coupling portion 31 is circular in cross section and includes a second outer surface 311, a second inner surface 312, and a second axle hole 313 extending from the second outer surface 311 through the second inner surface 312. The second outer surface 311 of the second coupling portion 31 includes a second recessed portion 314 around the second axle hole 313. The second recessed portion 314 of the second coupling portion 31 includes an engagement hole 315. The second inner surface 312 of the second coupling portion 31 includes an annular groove 316 around the second axle hole 313 and located corresponding to the flange 127 of the first coupling portion 12. At least one positioning member 317 is disposed on the second inner surface 312, is located around the annular groove 316, and is engaged in the at least one positioning groove 128 or the receiving groove 120. In this embodiment, the lower rod 3 includes six positioning members 317 for coupling with the six positioning grooves 128 or the receiving groove 120. A limiting member 318 protrudes from the second inner surface 312 of the second coupling portion 31, is longer than the positioning member 317, and is movable in the limiting groove 129.

The supporting rod 4 is mounted to a lower end of the lower rod 3 and includes an upper end having a coupling section 41 and a lower end having a supporting section 42. The coupling section 41 extends into the coupling groove 32 of the lower rod 3 and includes a plurality of coupling holes 411 at different heights. A coupling knob 412 extends through one of the plurality of coupling holes 411 of the coupling section 41 into the coupling hole 321 of the lower rod 3 to fix the supporting rod 4 to the lower end of the lower rod 3. The supporting section 42 includes a rectilinear section 43 connected to a lower end of the coupling section 41. The rectilinear section 43 includes an arcuate portion 44 at a lower end thereof. The arcuate portion 44 includes a central, upper portion connected to the rectilinear portion 43 and a bend portion 441 at a side thereof. The bend portion 441 is elastic. The arcuate portion 44 further includes a bottom 442 adapted to contact with a ground and located below the bend portion 441. An anti-slip pad 443 is mounted to the bottom 442. The bend portion 441 further includes an upper inner face 444 and a lower inner face 445. An upper abutting plate 446 protrudes from the upper inner face 444. A lower abutting plate 447 protrudes from the lower inner face 445 and is spaced from the upper abutting plate 446 by a spacing 448 (see FIGS. 7 and 12).

The locking device 5 includes a turn knob 51, an axle 52, an elastic element 53, an assembling piece 54, and a cap 55. The turn knob 51 includes a gripping portion 511 and a pivotal portion 512 connected to the gripping portion 511. The pivotal portion 512 of the turn knob 51 is mounted in the first recessed portion 124 of the first coupling portion 12 of the upper rod 1. The pivotal portion 512 of the turn knob 51 includes a pivotal hole 513, a first side 514 corresponding to a locking position, and a second side 515 corresponding to an unlocking position. The first side 514 extends at a non-parallel angle to the second side 515. The axle 52 includes a first side having a pivotal portion 521 pivotably connected to the pivotal hole 513 of the pivotal portion 512 of the turn knob 51. The axle 52 further includes a second side having a shank portion 522 extending through the first axle hole 123 and the second axle hole 313. The shank portion 522 of the axle 52 includes a connecting end 523 extending in the second recessed portion 314 and having a threaded portion 524. The elastic element 53 biases the first coupling portion 12 and the second coupling portion 31 to disengage the positioning members 317 from the positioning grooves 128 when in the turn knob 51 is in the unlocking position. In this embodiment, the elastic element 53 is a compression spring mounted in the annular groove 316 of the second coupling portion 31 and includes two ends respectively abutting the first coupling portion 12 and the second coupling portion 31. The assembling piece 54 has a width larger than a diameter of the second axle hole 313. The assembling piece 54 is received in the second recessed portion 314 of the second coupling portion 31 and includes a screw hole 541 in threading connection with the threaded portion 524 of the connecting end 523 of the axle 52. The cap 55 includes a head 551 and a tab 552 extending from the head 551. The tab 552 of the cap 55 engages with the engagement hole 315 of the second coupling portion 31, and the head 551 of the cap 55 covers the second recessed portion 314 to improve the assembly quality.

Figure 4:
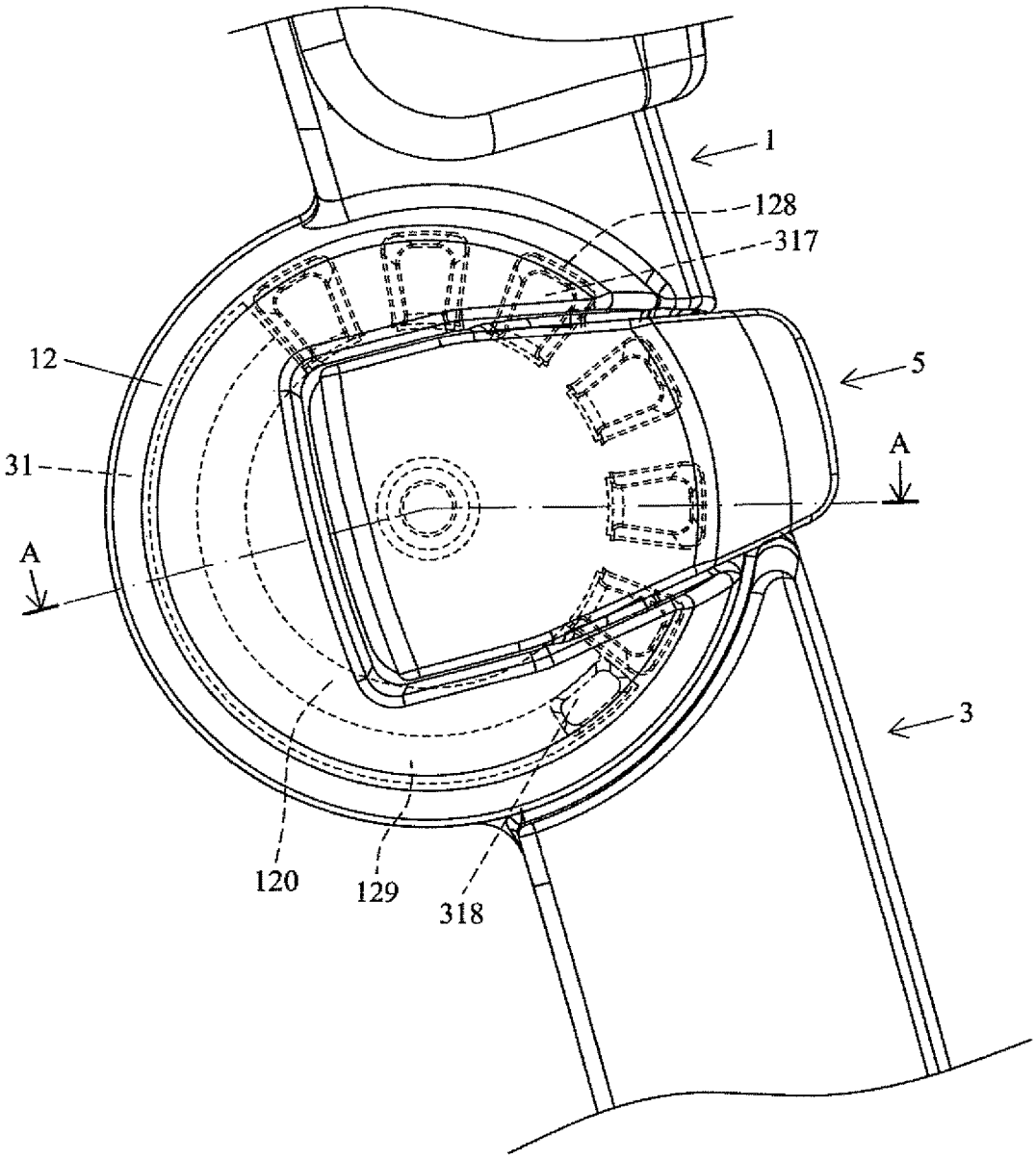
FIG. 4 is an enlarged view of a portion of the foldable crutch of FIG. 3.
Figure 5:
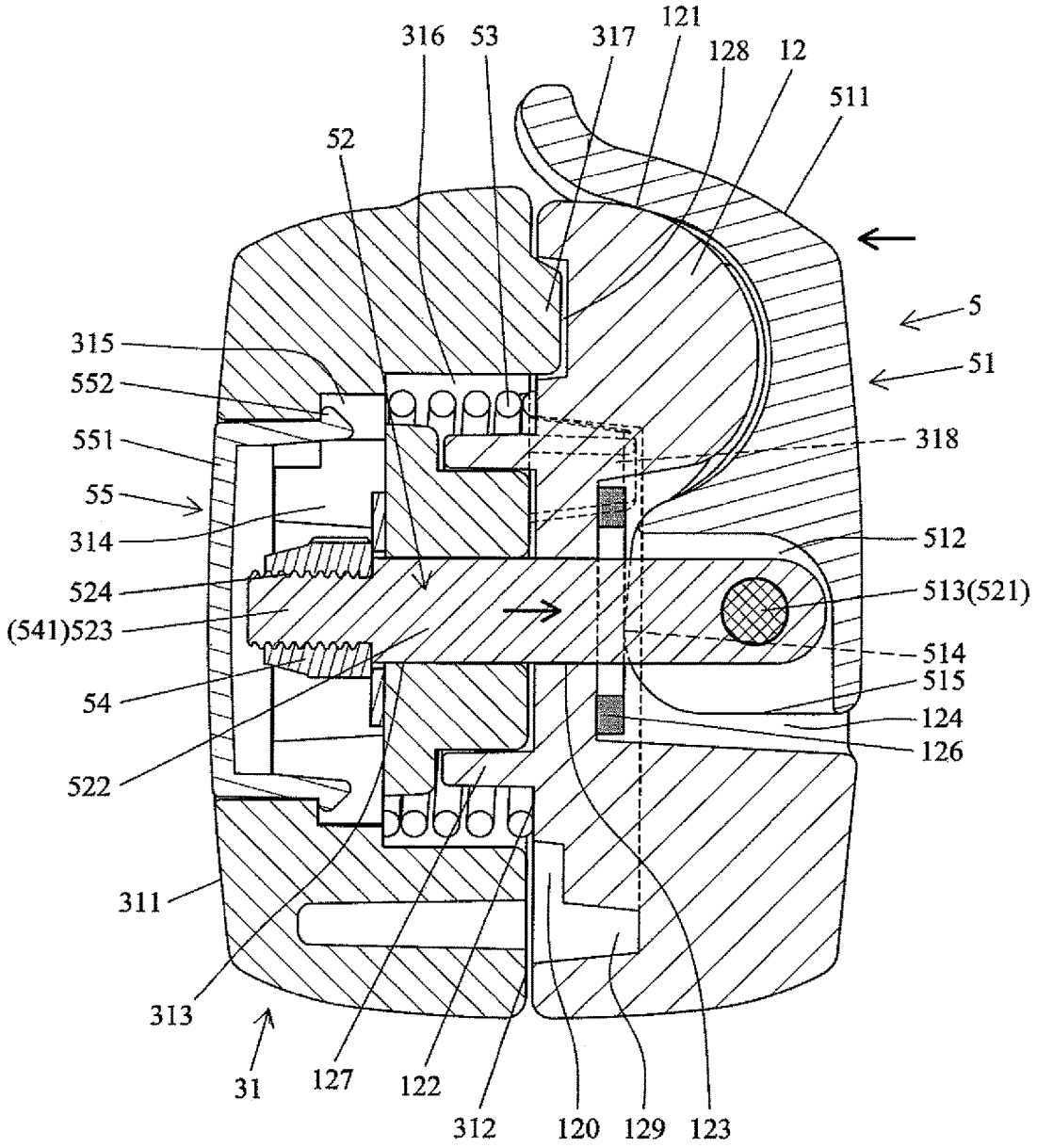
FIG. 5 is a cross sectional view taken along section line A-A of FIG. 4.

With reference to FIGS. 4 and 5, when the turn knob 51 is in the locking position, the first side 514 of the turn knob 51 faces the first axle hole 123 and the abutment plate 126. The turn knob 51 abuts the first outer surface 121 of the first coupling portion 12. The second coupling portion 31 is pulled by the axle 52 toward the first coupling portion 12, such that the six positioning members 317 engage with the six positioning grooves 128. Thus, the upper rod 1 and the lower rod 3 are in an extended state. The six positioning members 317 engage with the six positioning grooves 128 to provide a larger contact area, thereby increasing the positioning stability of the extended state.

Figure 6:
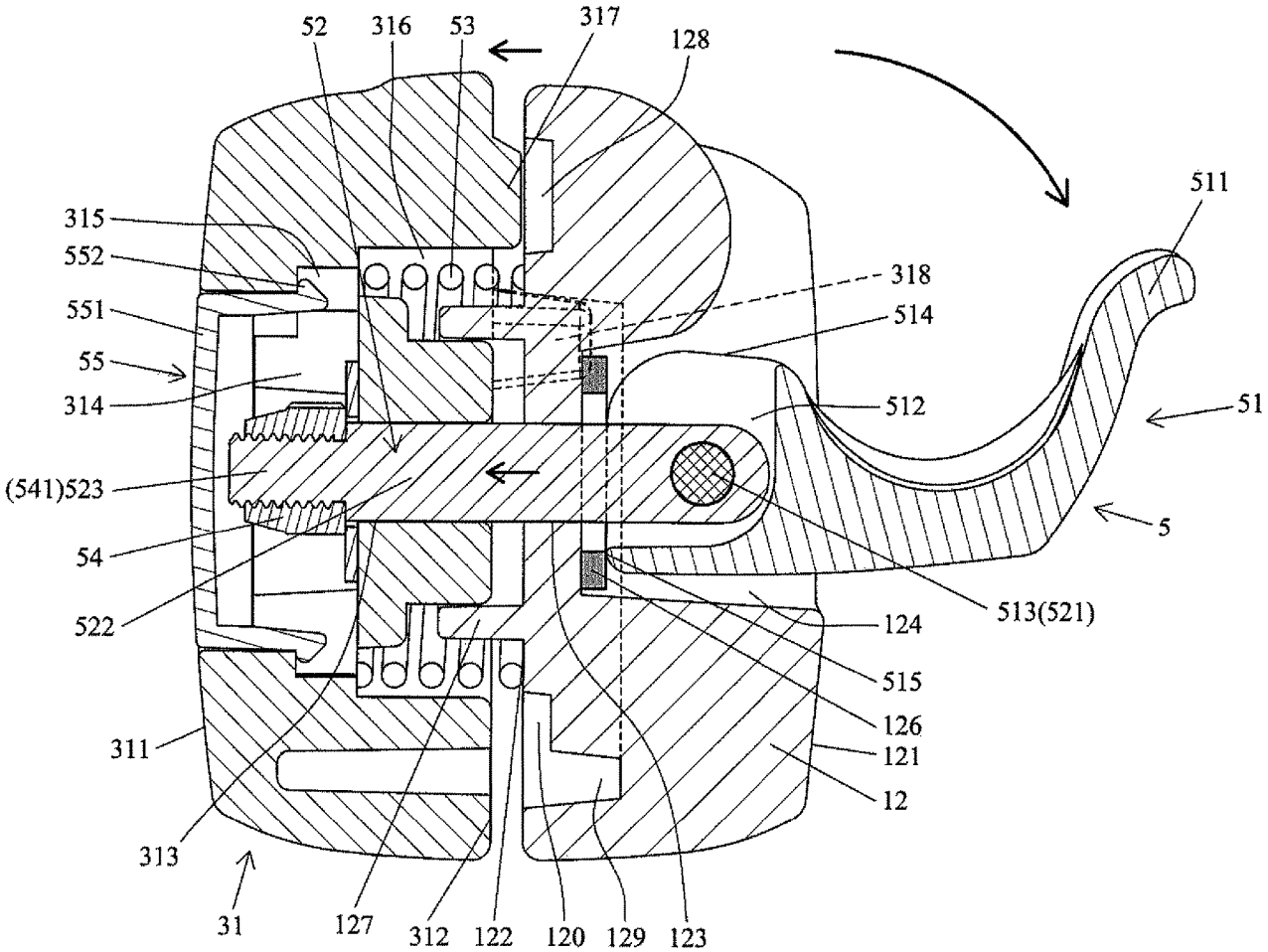
FIG. 6 is a view similar to FIG. 5, with a turn knob pivoted to an unlocking position.
Figure 7:
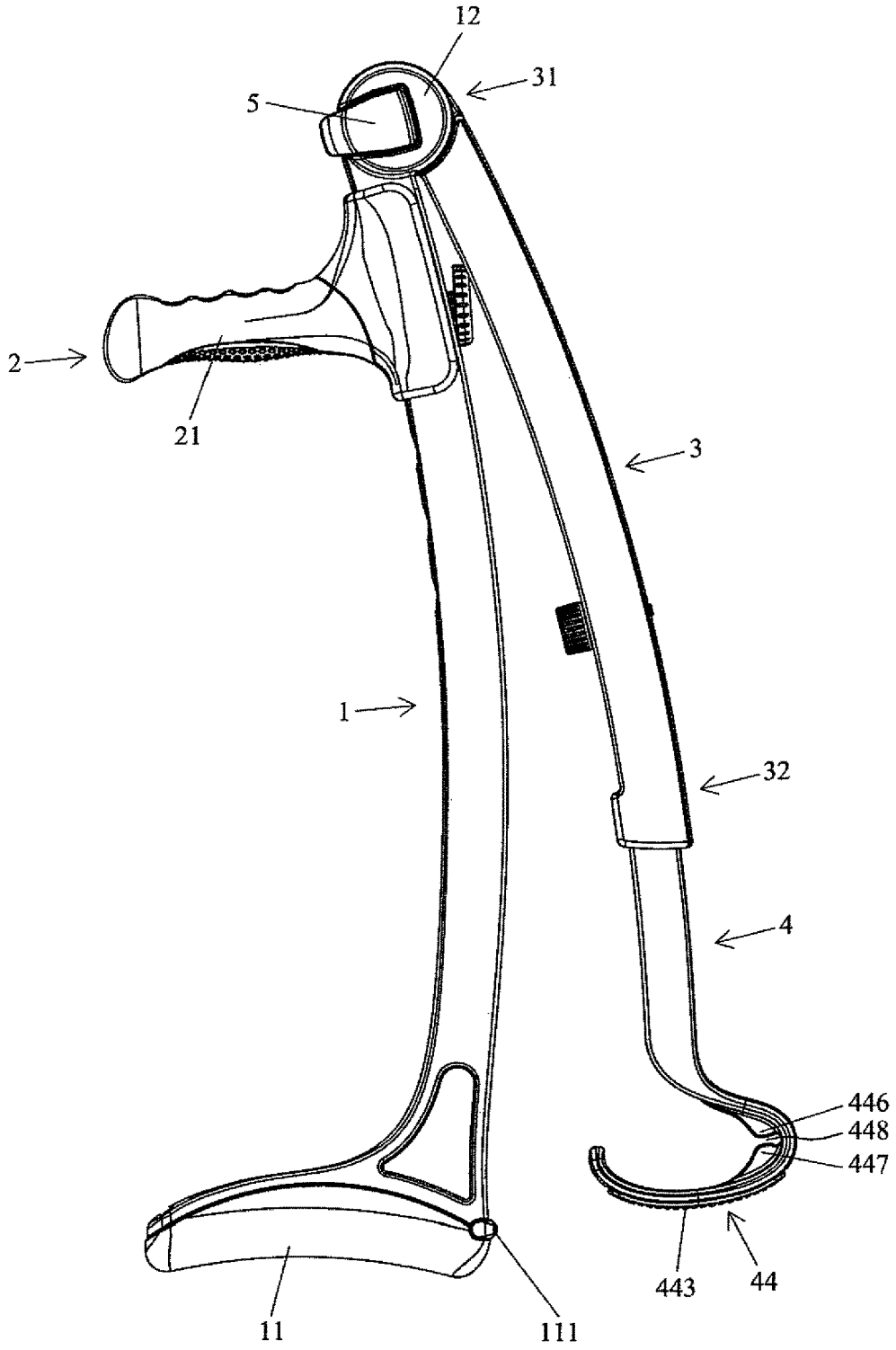
FIG. 7 is a perspective view of the foldable crutch of FIG. 3, with the foldable crutch being in a folded state.
Figure 8:
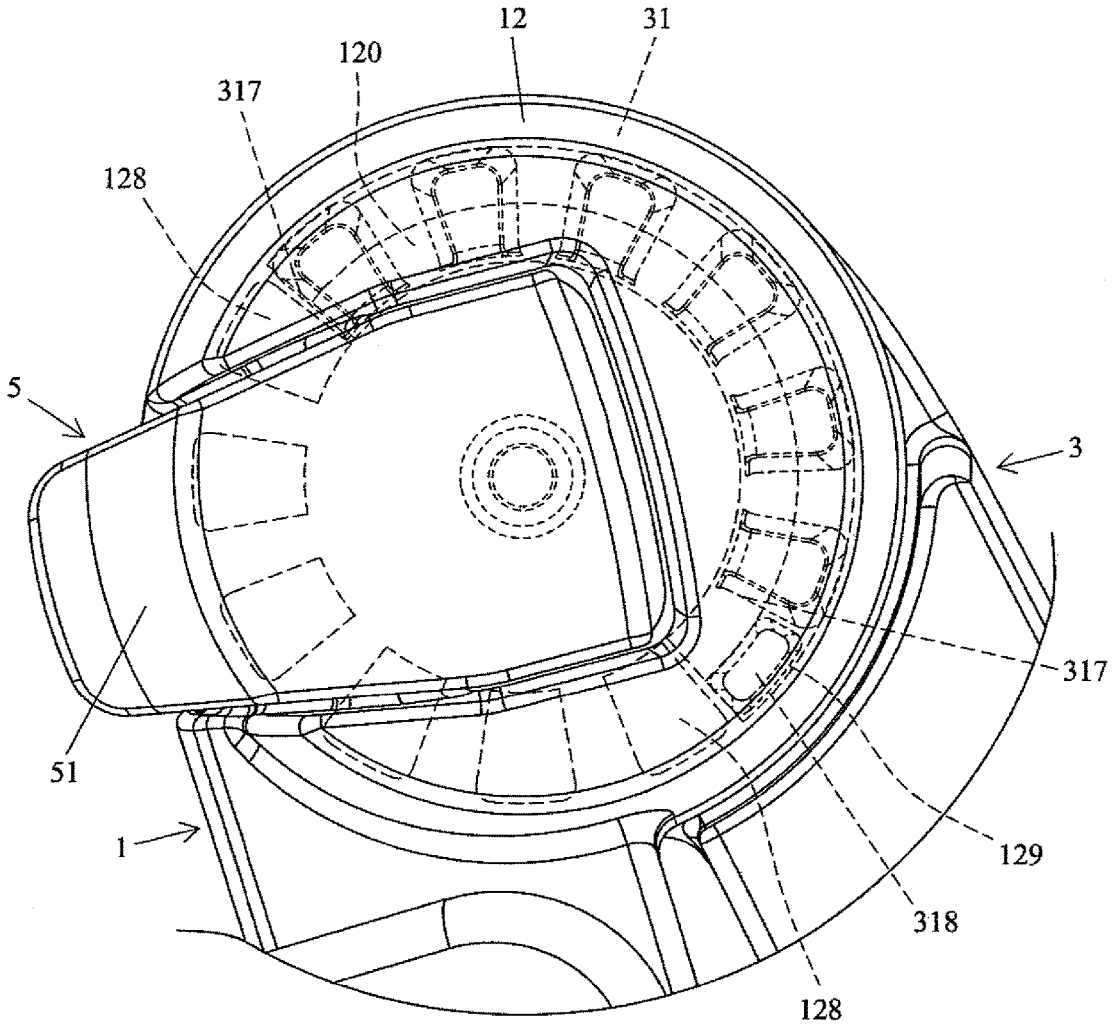
FIG. 8 is an enlarged view of a portion of the foldable crutch of FIG. 7.

With reference to FIGS. 6-8, when the turn knob 51 is turned to the unlocking position, the second side 515 of the pivotal portion 512 of the turn knob 51 faces the first axle hole 123 and abuts the abutment plate 126. The positioning members 317 disengage from the positioning grooves 128 under the action of the elastic force of the elastic element 53. Thus, the upper rod 1 is pivotable relative to the lower rod 3 to a folding state. During the pivotal movement to the folding state, the limiting member 318 moves along the limiting groove 129 to improve the stability of the pivotal movement. Then, when the turn knob 51 is moved back to the unlocking position while the first rod 1 and the second rod 3 are in the folding state, the positioning member 317 is engaged in the receiving groove 120. As shown in FIG. 8, sidewalls of two outermost members 317 abut against inner walls of the receiving groove 120 to provide the stability.

Figure 9:
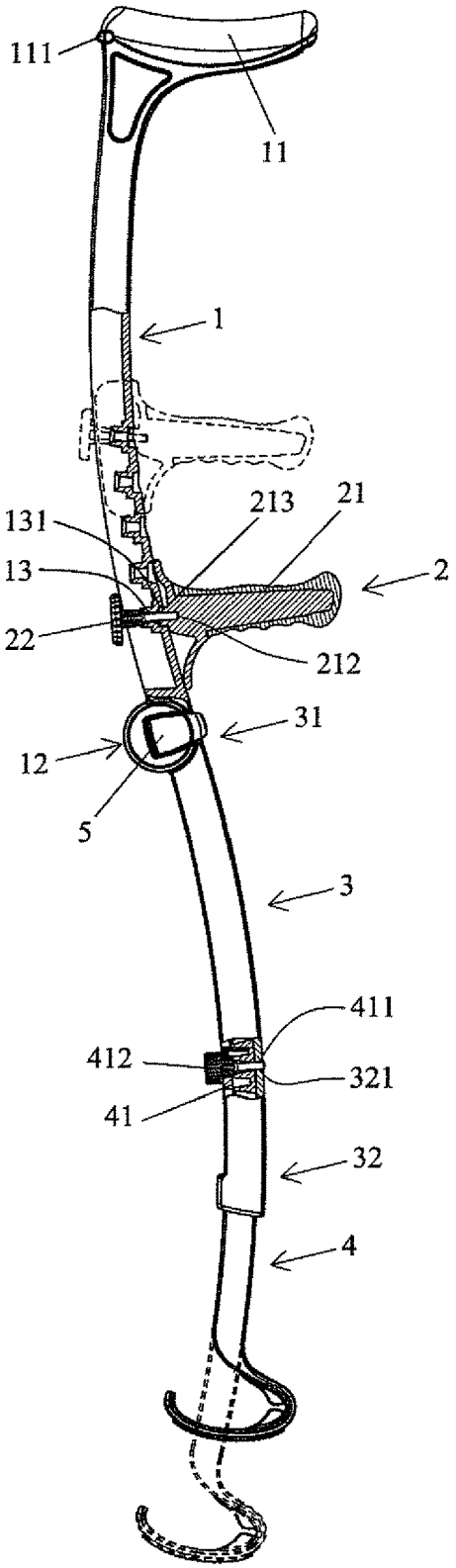
FIG. 9 is a diagrammatic view illustrating adjustment of the position of a handle and a supporting rod.

With reference to FIG. 9, in use, the user extends the connecting knob 22 through one of the plurality of coupling holes 13 of the upper rod 1 and the coupling hole 212 of the handle 2 to fix the handle 2 at a desired height. Furthermore, the coupling knob 412 of the supporting rod 4 extends through one of the plurality of coupling holes 411 and the coupling hole 321 of the lower rod 3 to provide a suitable overall length of the foldable crutch, providing wider applications.

Figure 10:
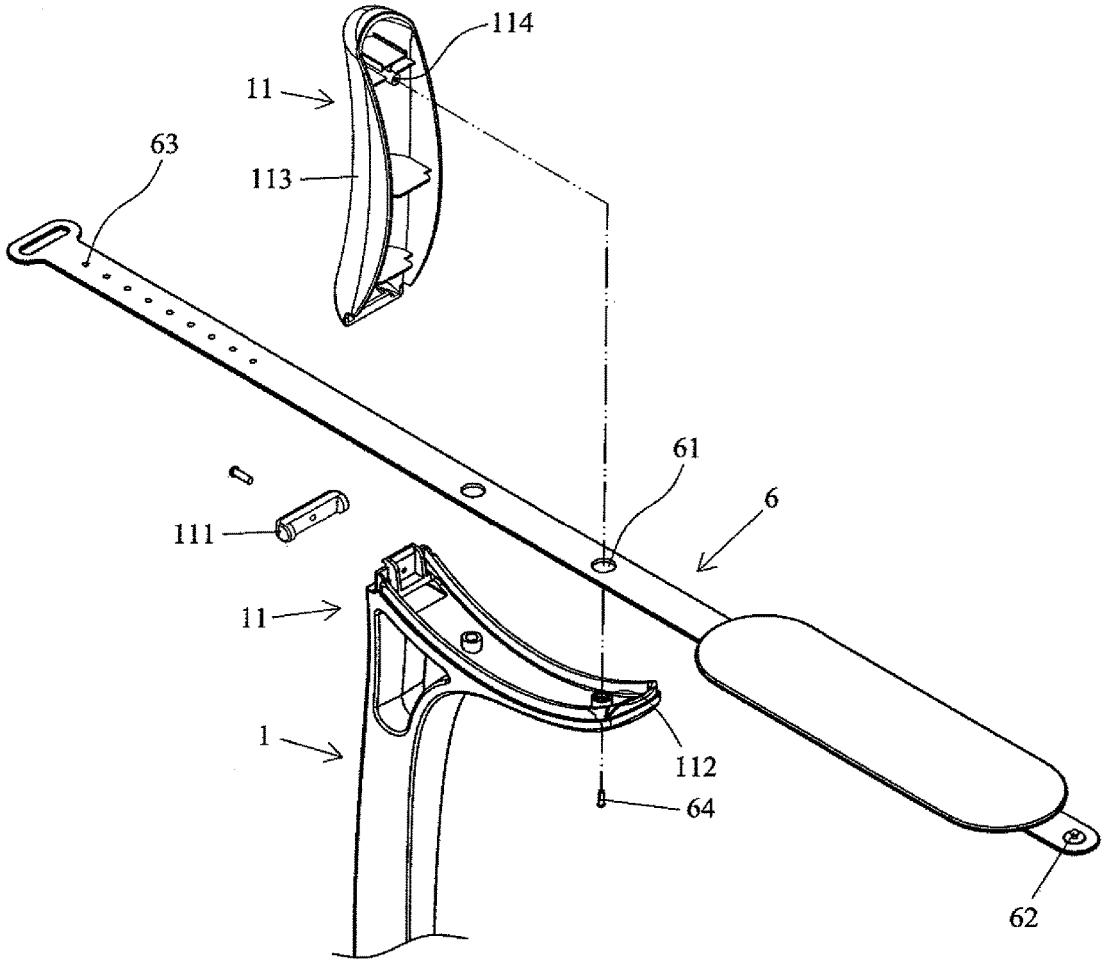
FIG. 10 is an exploded, perspective view of a portion of a foldable crutch of an embodiment including a strap.
Figure 11:
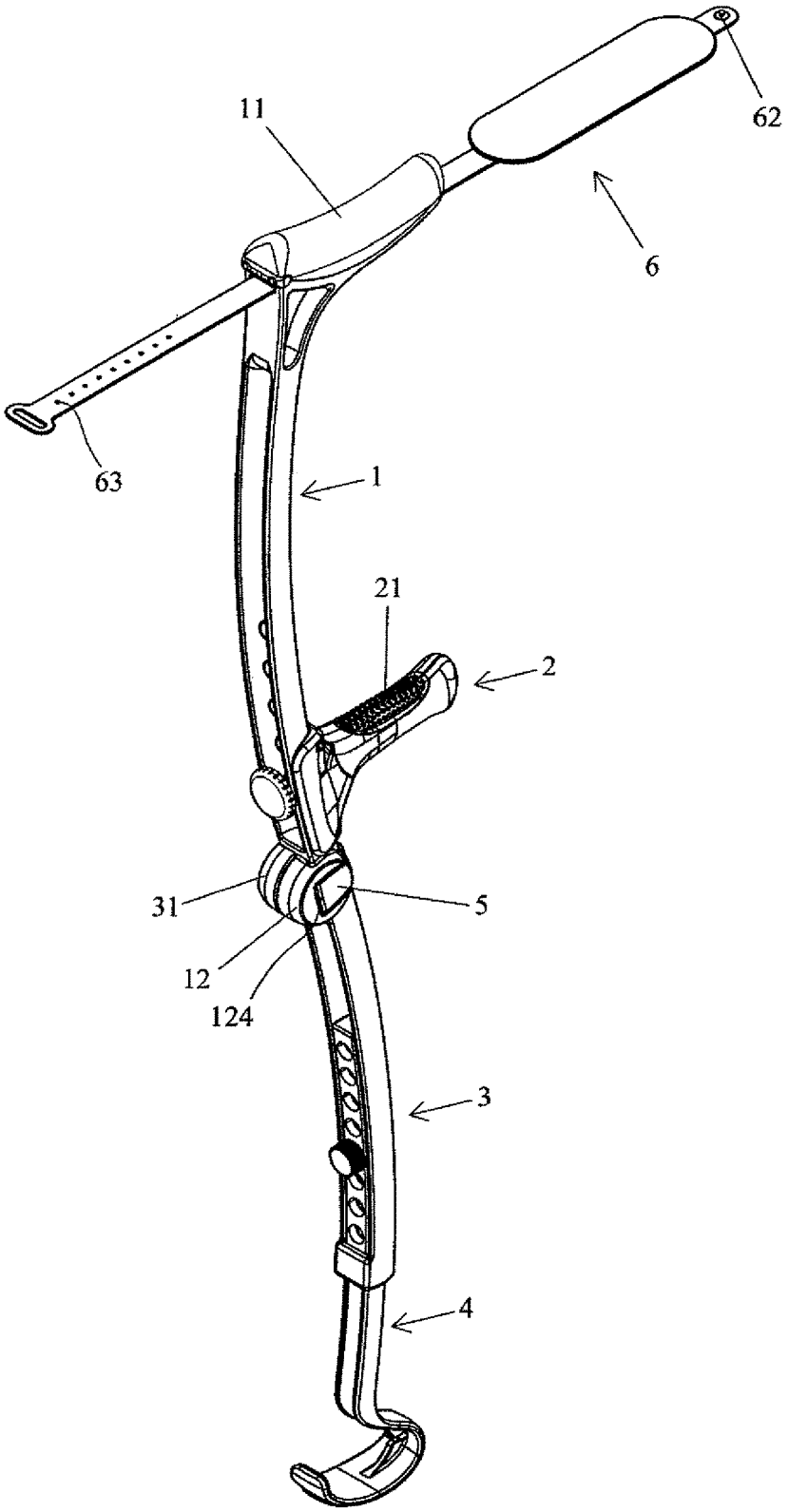
FIG. 11 is a perspective view of the foldable crutch including the strap.

With reference to FIGS. 10 and 11, the foldable crutch further includes a shoulder strap 6 disposed on the pad portion 11. The upper rod 1 includes a coupling peg 112 on a top end thereof. The pad portion 11 includes a pad 113 having a coupling hole 114 located corresponding to the coupling peg 112. The shoulder strap 6 includes an engaging hole 61 for coupling with the coupling peg 112 to avoid displacement of the shoulder strap 6. Furthermore, the shoulder strap 6 includes two connecting ends 62 and 63 at two ends thereof. The two connecting ends 62 and 63 are detachably coupled with each other. A fastener 64 extends through the coupling hole 114 of the pad 113 into the coupling peg 112. Thus, the shoulder strap 6 can be stably mounted above the upper rod 1.

Figures 12, 12A:
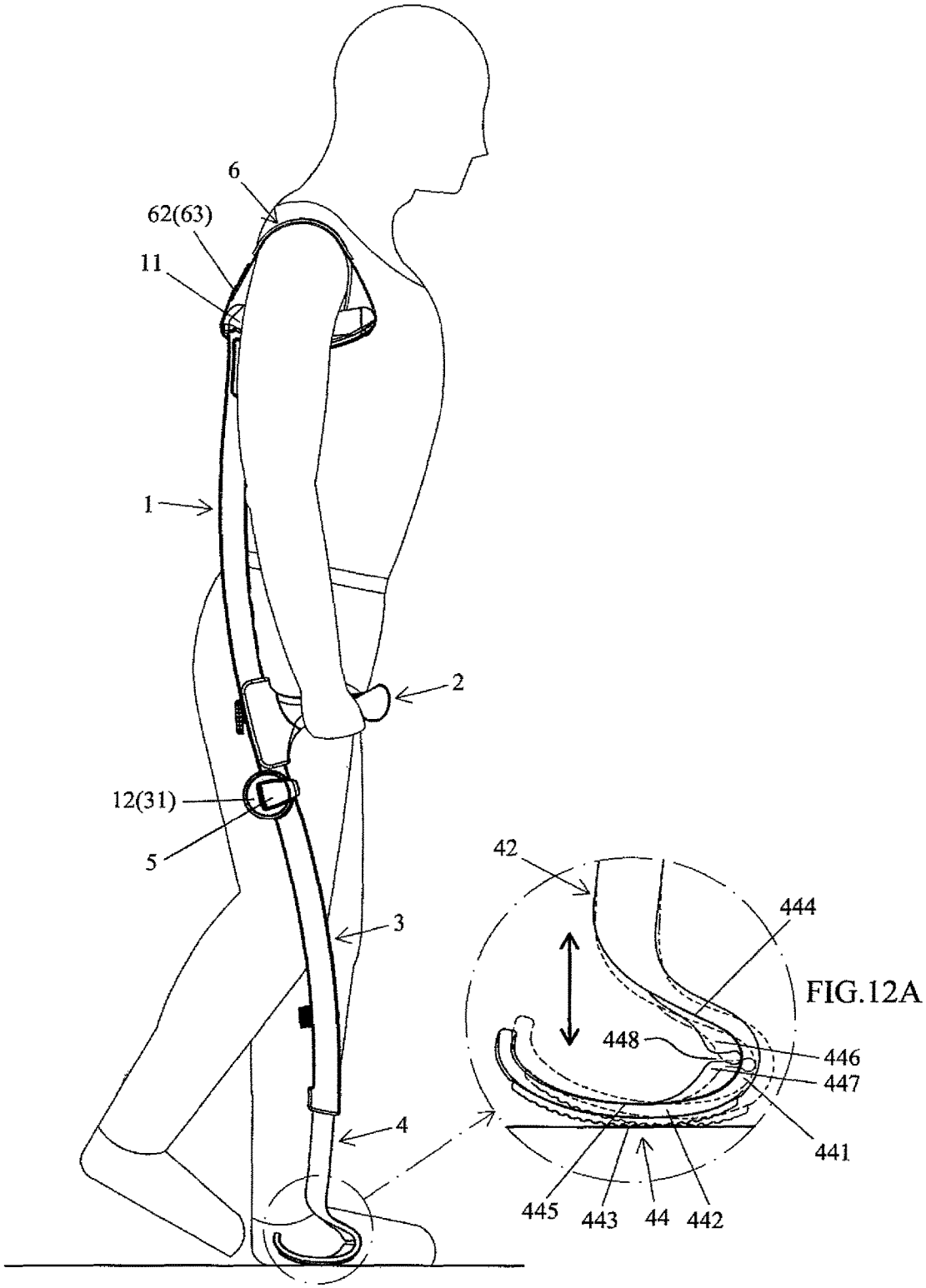
FIG. 12 is a diagrammatic view illustrating use of the folding crutch according to the present invention.
FIG. 12A is an enlarged view of a circled portion of FIG. 12.
Figure 13:
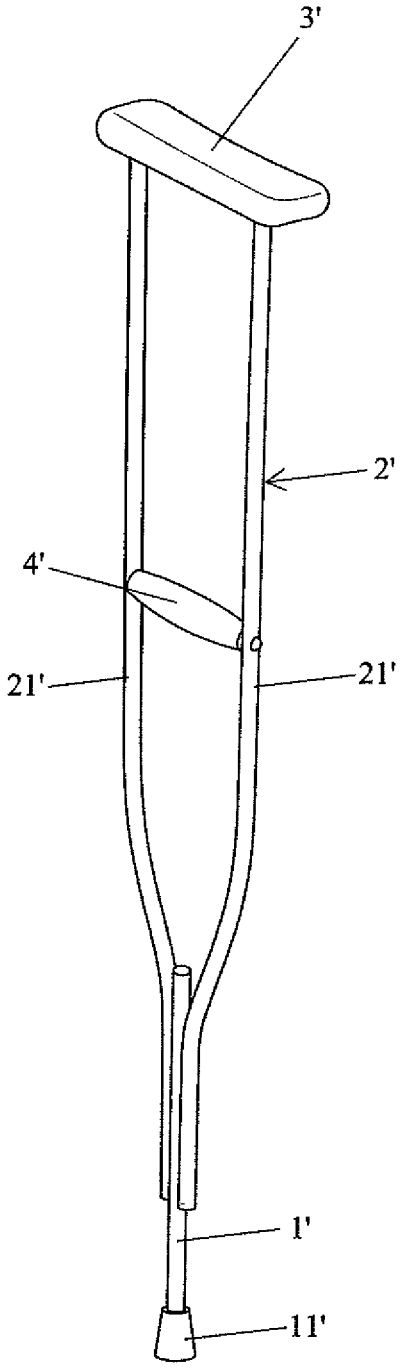
PRIOR ART F I G . 13
FIG. 13 is a perspective view of a conventional underarm crutch.

With reference to FIG. 12, in use, the two connecting ends 62 and 63 of the shoulder strap 6 are coupled with each other after the shoulder strap 6 is wrapped around a shoulder of the user. Thus, the foldable crutch will not fall off from the body of the user. Furthermore, the bend portion 441 of the arcuate portion 44 of the supporting rod 4 provides elasticity. The anti-slip pad 443 at the bottom 442 provides an anti-slip function to improve the safety. Furthermore, when the supporting rod 4 is subject to a larger downward force, the upper abutting plate 446 and the lower abutting plate 447 abut against each other to avoid excessive compression and excessive deformation while preventing breakage of the arcuate portion 44 as well as providing supporting elasticity and use safety.

In view of the foregoing, the upper rod 1 and the lower rod 3 of the foldable crutch according to the present invention can be stably positioned in the extended state by provision of the positioning members 317 and the positioning grooves 128. Furthermore, the user can turn the turn knob 51 to permit the upper rod 1 and the lower rod 3 to be pivoted to the folded state, reducing the overall length for the purposes of easy carriage, thereby providing convenient operation. The supporting rod 4 can be integrally formed on the lower end of the lower rod 3. Furthermore, the handle 2 can be mounted on an upper portion of the lower rod 3.

Although specific embodiments have been illustrated and described, numerous modifications and variations are still possible without departing from the scope of the invention. The scope of the invention is limited by the accompanying claims.

The invention claimed is:

1. A foldable crutch comprising:

an upper rod including a pad portion on a top end thereof, wherein the upper rod further includes a first coupling portion on a bottom end thereof, wherein the first coupling portion includes a first outer surface and a first inner surface, wherein the first coupling portion further includes a central portion having a first axle hole extending from the first outer surface through the first inner surface, wherein the first coupling portion further includes a peripheral portion surrounding the first axle hole, wherein at least one positioning groove and a receiving groove are defined in the peripheral portion and are spaced from each other in an angular direction;

a handle mounted on the upper rod;

a lower rod including an upper end having a second coupling portion mounted to the first coupling portion, wherein the second coupling portion includes a second outer surface, a second inner surface, and a second axle hole extending from the second outer surface through the second inner surface, wherein a positioning member is disposed on the second inner surface and is engaged in the at least one positioning groove or the receiving groove; and a locking device including a turn knob, an axle, an elastic element, and an assembling piece, wherein the turn knob includes a gripping portion and a pivotal portion connected to the gripping portion, wherein the pivotal portion of the turn knob is mounted to the first coupling portion of the upper rod, wherein the pivotal portion of the turn knob includes a first side corresponding to a locking position and a second side corresponding to an unlocking position, wherein the first side extends at a non-parallel angle to the second side, wherein the axle includes a first side having a pivotal portion pivotably connected to the pivotal portion of the turn knob, wherein the axle further includes a second side having a shank portion extending through the first axle hole and the second axle hole, wherein the elastic element biases the first coupling portion and the second coupling portion to disengage the positioning member from the at least one positioning groove when the turn knob is in the unlocking position, wherein the assembling piece has a width larger than a diameter of the second axle hole, wherein the assembling piece is disposed on the second coupling portion and is coupled to an end of the shank portion of the axle, wherein when the turn knob is in the locking position, the first side of the turn knob faces the first axle hole, the second coupling portion is pulled by the axle toward the first coupling portion, such that the positioning member engages with the at least one positioning groove, and wherein when the turn knob is turned to the unlocking position, the second side of the pivotal portion of the turn knob faces the first axle hole, the positioning member disengages from the at least one positioning groove, and the upper rod is pivotable relative to the lower rod to a folding state, and wherein when the turn knob is moved back to the unlocking position while the first rod and the second rod are in the folding state, the positioning member is engaged in the receiving groove.

2. The foldable crutch as claimed in claim 1, wherein the first inner surface of the first coupling portion includes a flange around the first axle hole, wherein the second inner surface of the second coupling portion includes an annular groove around the second axle hole and located corresponding to the flange of the first coupling portion, and wherein the elastic element is a compression spring mounted in the annular groove of the second coupling portion and includes two ends respectively abutting the first coupling portion and the second coupling portion.

3. The foldable crutch as claimed in claim 1, wherein the first outer surface of the first coupling portion includes a central portion having a first recessed portion around the first axle hole, wherein an abutment plate is mounted in the first recessed portion, wherein the pivotal portion of the turn knob is received in the first recessed portion, wherein the second outer surface of the second coupling portion includes a second recessed portion around the second axle hole, wherein the shank portion of the axle includes a connecting end extending in the second recessed portion and having a threaded portion, wherein the assembling piece is received in the second recessed portion and has a screw hole in threading connection with the threaded portion of the connecting end of the axle.

4. The foldable crutch as claimed in claim 3, wherein the second recessed portion of the second coupling portion includes an engagement hole, wherein the locking device further includes a cap, wherein the cap includes a head and a tab extending from the head, wherein the tab of the cap engages with the engagement hole of the second coupling portion, and wherein the head of the cap covers the second recessed portion.

5. The foldable crutch as claimed in claim 1, wherein the at least one positioning groove of the first coupling portion includes a plurality of positioning grooves located in a range of 180° around the first axle hole, wherein the receiving groove extends another 180° around the first axle hole, wherein a limiting groove is disposed in the receiving groove, wherein a limiting member protrudes from the second inner surface of the second coupling portion, is longer than the positioning member, and is movable in the limiting groove.

6. The foldable crutch as claimed in claim 1, further comprising a supporting rod, wherein the lower rod includes a central portion having a coupling groove, wherein the lower rod includes a lateral wall having a coupling hole in communication with the coupling groove, wherein the supporting rod is mounted to a lower end of the lower rod and includes an upper end having a coupling section and a lower end having a supporting section, wherein the coupling section includes a plurality of coupling holes at different heights, and wherein a coupling knob extends through one of the plurality of coupling holes of the coupling section into the coupling hole of the lower rod.

7. The foldable crutch as claimed in claim 1, further comprising a supporting rod mounted to a lower end of the lower rod, wherein the supporting rod includes an upper end having a coupling section and a lower end having a supporting section, wherein the coupling section is coupled to the lower rod, wherein the supporting section includes a rectilinear section connected to a lower end of the coupling section, wherein the rectilinear section includes an arcuate portion at a lower end thereof, wherein the arcuate portion includes a central, upper portion connected to the rectilinear portion and a bend portion that is elastic, wherein the arcuate portion further includes a bottom adapted to contact with a ground and located below the bend portion, wherein the bend portion includes an upper inner face and a lower inner face, wherein an upper abutting plate protrudes from the upper inner face, and wherein a lower abutting plate protrudes from the lower inner face and is spaced from the upper abutting plate by a spacing.

8. The foldable crutch as claimed in claim 1, wherein the upper rod includes a central portion having a plurality of coupling holes located at different heights, wherein the handle includes a handgrip and a connecting knob, wherein the handgrip is disposed on the upper rod and includes an engaging portion on a side thereof, wherein the engaging portion includes a coupling hole, wherein the engaging portion is mounted to one of the different heights, and wherein the connecting knob extends through one of the plurality of coupling holes of the upper rod into the coupling hole of the handle.

9. The foldable crutch as claimed in claim 1, further comprising a shoulder strap disposed on the pad portion.

10. The foldable crutch as claimed in claim 9, wherein the upper rod includes a coupling peg on a top end thereof, wherein the pad portion includes a pad having a coupling hole located corresponding to the coupling peg, wherein the shoulder strap includes an engaging hole for coupling with the coupling peg, wherein the shoulder strap includes two connecting ends at two ends thereof, wherein the two connecting ends are detachably coupled with each other, and wherein a fastener extends through the coupling hole of the pad into the coupling peg.

* * * * *